US007024354B2

(12) United States Patent
Ozawa

(10) Patent No.: US 7,024,354 B2
(45) Date of Patent: Apr. 4, 2006

(54) SPEECH DECODER CAPABLE OF DECODING BACKGROUND NOISE SIGNAL WITH HIGH QUALITY

(75) Inventor: Kazunori Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 643 days.

(21) Appl. No.: 09/985,853

(22) Filed: Nov. 6, 2001

(65) Prior Publication Data

US 2002/0087308 A1 Jul. 4, 2002

(30) Foreign Application Priority Data

Nov. 6, 2000 (JP) ..... 2000-337805

(51) Int. Cl.

| | |
|---|---|
| ***G10L 19/04*** | (2006.01) |
| ***G10L 19/08*** | (2006.01) |
| ***G10L 19/10*** | (2006.01) |
| ***G10L 19/14*** | (2006.01) |

(52) U.S. Cl. ..... 704/219; 704/220; 704/225

(58) Field of Classification Search ..... 704/262, 704/264, 258, 219

See application file for complete search history.

(56) References Cited

U.S. PATENT DOCUMENTS

| | | | | |
|---|---|---|---|---|
| 5,732,389 | A * | 3/1998 | Kroon et al. | 704/223 |
| 5,787,388 | A * | 7/1998 | Hayata | 704/215 |
| 5,946,651 | A * | 8/1999 | Jarvinen et al. | 704/219 |
| 6,526,376 | B1 * | 2/2003 | Villette et al. | 704/207 |
| 6,526,378 | B1 * | 2/2003 | Tasaki | 704/224 |
| 6,556,966 | B1 * | 4/2003 | Gao | 704/220 |
| 6,910,009 | B1 * | 6/2005 | Murashima | 704/225 |

FOREIGN PATENT DOCUMENTS

| | | | |
|---|---|---|---|
| EP | 0 863 500 | A2 | 9/1998 |
| EP | 1024477 | A1 * | 8/2000 |
| GB | 2 312 360 | A | 10/1997 |
| JP | 01-267700 | A | 10/1989 |
| JP | 09-54600 | A | 2/1997 |
| JP | 09-244695 | A | 9/1997 |
| JP | 10-83200 | A | 3/1998 |
| JP | 10-171497 | A | 6/1998 |

(Continued)

OTHER PUBLICATIONS

Tasaki, H.; Takahashi, S.; "Post noise smoother to improve low bit rate speech-coding performance" Speech Coding Proceedings, 1999 IEEE Workshop on □□ Jun. 20-23, 1999 Pages(s): 159-161 □□.*

(Continued)

*Primary Examiner*—W. R. Young
*Assistant Examiner*—Matthew J. Sked
(74) *Attorney, Agent, or Firm*—Sughrue Mion, PLLC

(57) ABSTRACT

In response to a coded speech signal output from a speech coder, a speech decoder decodes the coded speech signal into a reproduction speech signal. If the reproduction speech signal meets predetermined conditions, for example, "silence", "unvoiced sound", and the like, the speech decoder further operates as the following. The speech decoder calculates spectral parameters based on the reproduction speech signal, and calculates an excitation signal on the basis of the reproduction speech signal and the spectral parameters. In the calculation, a level of the excitation signal is also obtained. The speech decoder smoothes in time at least one of the spectral parameters and the level of the excitation signal. The speech decoder synthesizes the excitation signal by using the synthesis filter constructed with the spectrum parameters, so as to reproduce the speech signal. The speech signal has an excellent quality even if a bit rate is low.

14 Claims, 2 Drawing Sheets

FOREIGN PATENT DOCUMENTS

| | | | |
|---|---|---|---|
| JP | 11-175083 | A | 7/1999 |
| JP | 2000-89797 | A | 3/2000 |
| JP | 2000-235400 | A | 8/2000 |

OTHER PUBLICATIONS

A. Murashima et al., "A Post-Processing Technique to Improve Coding Quality of CELP Under Background Noise", *IEEE*, 2000, pp. 102-104.

Shroeder et al., "Code-Excited Linear Prediction (CELP): High-Quality Speech at Very Low Bit Rates", *Proc. ICASSP 85*, vol. 3 of 4, Mar. 26-29, 1985, pp. 937-940.

Kleijn et al., "Improved Speech Quality and Efficient Vector Quantization in SELP" *Proc. ICASSP 88*, vol. 1, 1988, pp. 155-158.

Laflamme et al., "16 KBPS Wideband Speech Coding Technique Based on Algebraic CELP", *Proc. ICASSP 91*, vol. 1, May 14-17, 1991, pp. 13-16.

A. Murashima et al., "A Post-Processing Technique to Improve Coding Quality of CELP Under Background Noise", *IEEE*, 2000, pp. 102-104.

A. Murashima et al., "An improvement of the Wideband Speech Codec under Background Noise Conditions", *Proceedings of the 1999 Information and Systems Society Conference of IEICE*, D-14-4, p. 213.

Shroeder et al., "Code-Excited Linear Production (CELP): High-Quality Speech at Very Low Bit Rates", *Proc. ICASSP 85*, vol. 3 of 4, Mar. 26-29, 1985, pp. 937-940.

Kleijn et a., "Improved Speech Quality and Efficient Vector Quantization in SELP", *Proc. ICASSP 88*, vol. 1, 1988, pp. 155-158 no month or year.

Nakamizo, "Signal Analysis and System Identification", published by Corona, 1998, pp. 82-87 no month or year.

Laflamme et al., "16 KBPS Wideband Speech Coding Technique Based on Algebraic CELP", *Proc. ICASSP 91*, vol. 1, May 14-17, 1991, pp. 13-16.

Sugamura et al., "Speech Data Compression by LSP Speech Analysis-Synthesis Technique", *Journal of the Electronic Communications Society of Japan*, J64-A, 1981, pp. 599-606 no month or year.

* cited by examiner

SPEECH DECODER CAPABLE OF DECODING BACKGROUND NOISE SIGNAL WITH HIGH QUALITY

BACKGROUND OF THE INVENTION

This invention relates to a speech decoder for decoding a speech signal and, in particular, to a speech decoder that can decode a background noise signal with a high quality, the background noise signal being included in a speech signal coded at a low bit rate.

As a method for coding a speech signal at a high efficiency, CELP (Code Excited Linear Predictive Coding) is known in the art, and is described, for example, in M. Schroeder and B. Atal, "Code-excited linear prediction: High quality speech at very low bit rates" (Proc. ICASSP, pp. 937–940, 1985: hereinafter referred to as Document 1), Kleijn et al, "Improved speech quality and efficient vector quantization in CELP" (Proc. ICASSP; pp. 155–158, 1988: hereinafter referred to as Document 2), and so on. Documents 1 and 2 are incorporated herein by reference.

In the conventional method, on a transmission side, spectral parameters representative of spectral characteristics of a speech signal are extracted from the speech signal for each frame (e.g. 20 ms long) by the use of a linear predictive (LPC) analysis. Then, each frame is divided into subframes (e.g. 5 ms long). For each subframe, parameters (a gain parameter and a delay parameter corresponding to a pitch period) are extracted from an adaptive codebook on the basis of a preceding excitation signal. By the use of an adaptive codebook, the speech signal of the subframe is pitch-predicted. For an excitation signal obtained by the pitch prediction, an optimum excitation code vector is selected from an excitation codebook (vector quantization codebook) comprising predetermined kinds of noise signals and an optimum gain is calculated. Thus, an excitation signal is quantized.

The excitation code vector is selected so as to minimize an error power between a signal synthesized by the selected noise signal and the above-mentioned residual signal.

An index representative of the kind of the selected code vector, the gain, the spectral parameters, and the parameters of the adaptive codebook are combined by a multiplexer unit and transmitted.

In addition, as a technique to reduce the amount of calculations required to search the excitation codebook, various methods have been proposed.

For example, an ACELP (Algebraic Code Excited Linear Prediction) method is proposed. This method is described, for example, in C. Laflamme et al, "16 kbps wideband speech coding technique based on algebraic CELP" (Proc. ICASSP, pp. 13–16, 1991: hereinafter referred to as Document 3). Document 3 is incorporated herein by reference.

According to the method described in Document 3, an excitation signal is expressed by a plurality of pulses, and furthermore, each of positions of the pulses is represented by a predetermined number of bits and is transmitted. Herein, the amplitude of each pulse is restricted to +1.0 or −1.0. Therefore, the mount of calculations required to search the pulses can considerably be reduced.

However, according to the above-mentioned conventional methods and techniques, there is a problem that an excellent sound quality is obtained at a bit rate of 8 kb/s or more but, particularly when a background noise is superposed on a speech, the sound quality of a background noise part of a coded speech is deteriorated at a lower bit rate. This problem significantly arises, for example, in the case where the speech coding is carried out in the cellular phone, and so on.

According to the coding approaches described in Document 1 and Document 2, the reduction of the bit rate of the coding results in that the number of the bits included in the excitation codebook decreases, and thereby that the reproduction accuracy of waveforms is deteriorated. The deterioration of the waveform reproduction accuracy does not appear on high waveform-correlation signals such as speech signals, but significantly appears on low waveform-correlation signals such as background noise signals.

In the coding approach described in Document 3, an excitation signal is represented by the combination of pulses. The pulse combination is suitable for modeling a speech signal so that an excellent sound quality is obtained. However, a sound quality of a coded speech is significantly deteriorated at a lower bit rate because the number of pulses for a single subframe is not enough to represent the excitation signal with high accuracy.

The reason is as follows. The excitation signal is expressed by a combination of a plurality of pulses. Therefore, in a vowel period of the speech, the pulses are concentrated around a pitch pulse which gives a starting point of a pitch. In this event, the speech signal can be efficiently represented by a small number of pulses. On the other hand, with respect to a random signal such as the background noise, non-concentrated pulses must be produced. In this event, it is difficult to appropriately represent the background noise with a small number of pulses. Therefore, if the bit rate is lowered and the number of pulses is decreased, the sound quality for the background noise is drastically deteriorated.

In the light of the above-mentioned problems arising in the conventional methods and techniques, it is an object of this invention to remove the above-mentioned problems and to provide an improved speech decoder for decoding a speech signal where a background noise signal is superposed by coding of the above-mentioned methods and techniques. The improved speech decoder requires a relatively small amount of calculation but can decode the speech signal wit suppression of deterioration of the sound quality even if a bit rate is low.

SUMMARY OF THE INVENTION

In order to achieve the above-mentioned object, first aspect of this invention provides a speech decoder for decoding a coded speech signal into a reproduction speech signal and for reproducing a speech signal by the use of the reproduction speech signal, with the specific conditions of the reproduction speech signal.

The speech decoder according to the first aspect of the present invention includes: a spectral parameter calculating circuit, responsive to the reproduction speech signal, for calculating spectral parameters based on the reproduction speech signal; an excitation signal calculating circuit for calculating an excitation signal and for obtaining a level of the excitation signal, on the basis of the reproduction speech signal and the spectral parameters calculated by the spectral parameter calculating circuit; a smoothing circuit responsive to the spectral parameters and the excitation signal, for smoothing in time at least one of the spectral parameters and the level of the excitation signal, so as to output the spectral parameters and the excitation signal where at least one is subjected to smoothing; and a synthesis filter circuit having a synthesis filter constructed with the spectrum parameters output from the smoothing circuit, and for synthesizing the excitation signal by using the synthesis filter, so as to reproduce the speech signal; wherein the excitation signal calculating circuit, the smoothing circuit and the synthesis filter circuit operate in compliance with only predetermined conditions.

In the above speech decoder, the excitation signal calculation circuits may carry out an inverse-filtering for the reproduction speech signal by the use of the spectral parameters, so as to calculate the excitation signal. In addition, the above speech decoder may comprise a mode-judging circuit for judging a mode of the reproduction speech signal by extracting feature quantities from the reproduction speech signal, wherein the predetermined conditions comprises a mode condition that the mode of the reproduction speech signal is judged as a predetermined mode by the mode-judging circuit, the excitation signal calculating circuit. In this case, the smoothing circuit and the synthesis filter circuit operate in only the case where the mode condition is met. Herein, the predetermined mode is, for example, "silence" or "unvoiced sound."

Second aspect of this invention provides another speech decoder for decoding a coded speech signal into a reproduction speech signal and for reproducing a speech signal by the use of the reproduction speech signal.

The speech decoder according to the second aspect of the present invention includes: a spectral parameter calculating circuit, responsive to the reproduction speech signal, for calculating spectral parameters based on the reproduction speech signal; an excitation signal calculating circuit for calculating an excitation signal and for obtaining a level of the excitation signal, on the basis of the reproduction speech signal and the spectral parameters calculated by the spectral parameter calculating circuit; a pitch-prediction circuit which calculates a pitch period from either the reproduction speech signal or the excitation signal, carries out a pitch prediction by the use of pitch period to produce a pitch prediction signal, and calculates a residual signal by subtracting the pitch prediction signal from the excitation signal; a gain-calculating circuit for calculating a gain of at lease one of the pitch prediction signal and the residual signal both output from the pitch-prediction circuit; a smoothing circuit responsive to the spectral parameters and the gain, for smoothing in time at least one of the spectral parameters and the gain, so as to output the spectral parameters and the excitation signal where at least one is subjected to smoothing; and a synthesis filter circuit having a synthesis filter constructed with the spectrum parameters output from the smoothing circuit, and for newly producing an excitation signal as a proper excitation signal on the basis of the gain, the pitch prediction signal and the residual signal, and thereby for synthesizing the proper excitation signal by using the synthesis filter, so as to reproduce the speech signal.

In the speech decoder according to the second aspect of the present invention, the excitation signal calculation circuits may carry out an inverse-filtering for the reproduction speech signal by the use of the spectral parameters, so as to calculate the excitation signal.

Third aspect of this invention provides a method of reproducing a speech signal, comprising: first step of decoding a coded speech signal output from a speech coder, so as to produce a reproduction speech signal; second step of calculating spectral parameters based on the reproduction speech signal; third step of calculating an excitation signal and obtaining a level of the excitation signal, on the basis of the reproduction speech signal and the spectral parameters; fourth step of smoothing in time at least one of the spectral parameters and the level of the excitation signal, so as to output the spectral parameters and the excitation signal where at least one is subjected to the smoothing; and fifth step of synthesizing the excitation signal by using the synthesis filter constructed with the spectrum parameters, so as to reproduce the speech signal; wherein the second to fifth steps are carried out in only a case where predetermined conditions are met, while the reproduction speech signal is handled as the speech signal in another case where predetermined conditions are not met.

In the reproducing method according to the third aspect of the present invention, the third step may be carried out so that the reproduction speech signal is subjected to an inverse-filtering using the spectral parameters, to thereby calculate the excitation signal. In addition, the above reproducing method may comprise sixth step of judging a mode of the reproduction speech signal by extracting feature quantities from the reproduction speech signal, wherein the predetermined conditions comprises a mode condition that the mode of the reproduction speech signal is judged as a predetermined mode. Herein, the predetermined mode is, for example, "silence" or "unvoiced sound."

Fourth aspect of this invention provides another method of reproducing a speech signal, comprising: first step of decoding a coded speech signal output from a speech coder, so as to a reproduction speech signal; second step of calculating spectral parameters based on the reproduction speech signal; third step of calculating an excitation signal and obtaining a level of the excitation signal, on the basis of the reproduction speech signal and the spectral parameters; fourth step of calculating a pitch period from either the reproduction speech signal or the excitation signal, carrying out a pitch prediction by the use of pitch period to produce a pitch prediction signal, and subtracting the pitch prediction signal from the excitation signal to calculate a residual signal; fifth step of calculating a gain of at lease one of the pitch prediction signal and the residual signal; sixth step of smoothing in time at least one of the spectral parameters and the gain, so as to output the spectral parameters and the excitation signal where at least one is subjected to the smoothing; and seventh step of newly producing an excitation signal as a proper excitation signal on the basis of the gain, the pitch prediction signal and the residual signal, and then, synthesizing the proper excitation signal by the use of the synthesis filter constructed with the spectrum parameters, so that the speech signal is reproduced.

In the reproducing method according to the fourth aspect of the present invention, the third step may be carried out so that the reproduction speech signal is subjected to an inverse-filtering using the spectral parameters, to thereby calculate the excitation signal.

It is to be understood that both the foregoing description and the following detailed description are exemplary and explanatory only and are not restrictive of the invention, as claimed.

BRIEF DESCRIPTION OF THE DRAWING

The accompanying drawings, which are incorporated in and constitute a part of this specification, illustrate embodiments of the present invention, and together with the description, serve to explain the principles of the present invention, In the drawings.

DETAILED DESCRIPTION OF THE PREFERRED EMBODIMENTS

A speech decoder according to a preferred embodiment comprises a decoding circuit for decoding a coded speech signal into a reproduction speech signal and a reproducing circuit for reproducing a speech signal by the use of the reproduction speech signal. The decoding circuit may be a conventional speech decoder according to a technique disclosed in Document 1, 2, or 3. The reproducing circuit is arranged on a stage next to the decoding circuit.

Figure 1:
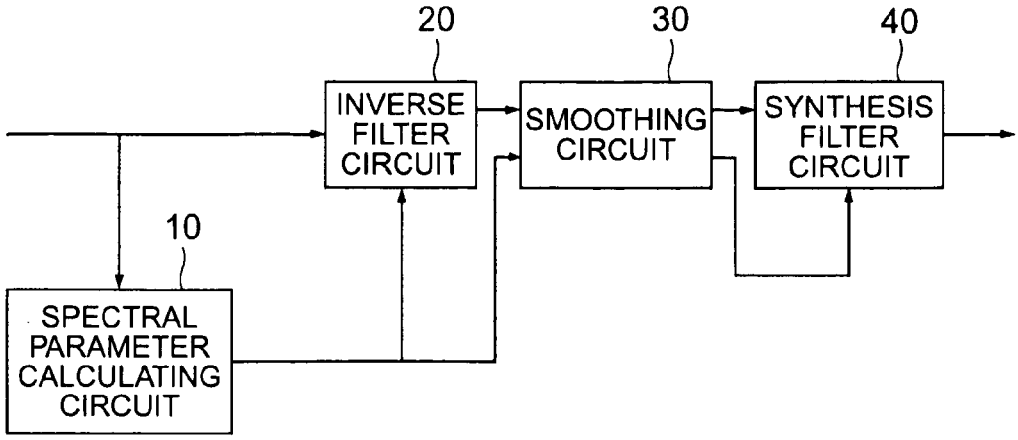
FIG. 1 is a block diagram schematically showing a speech decoder according to first embodiment of this invention.

FIG. 1 is a block diagram of a reproducing circuit of a speech decoder according to first embodiment.

The illustrated reproducing circuit comprises a spectral parameter calculating circuit 10, an inverse filter circuit 20, a smoothing circuit 30 and a synthesis filter circuit 40. The inverse filter circuit 20 serves as an excitation signal calculating circuit.

The spectral parameter calculating circuit 10 is supplied with the reproduction speech signal d(n), and then, on the basis of a linear prediction analysis by the use of the reproduction speech signal d(n), calculates spectral parameters with a predetermined degree $\alpha_i$ (i=1, . . . , P: e.g. P=10). The inverse filter circuit 20 carries out an inverse-filtering for the reproduction speech signal d(n) by the use of the spectral parameters $\alpha_i$. The inverse-filtering results in producing an excitation signal x(n). The smoothing circuit 30 receives the spectral parameters $\alpha_i$ and the excitation signal x(n) calculated by the inverse filter circuit 20, and then, smoothes in time at least one of the spectral parameters $\alpha_j$ and the RMS of the excitation signal x(n), so as to output the spectral parameters $\alpha_i$ and the excitation signal x(n) where at least one is subjected to smoothing. The synthesis filter circuit 40 has a synthesis filter constructed with the spectrum parameters $\alpha_i$ output from the smoothing circuit, and synthesizes the excitation signal x(n) by using the synthesis filter, so as to reproduce the speech signal.

In detail, the speech decoder according to the first embodiment operates as the following.

When supplied with the reproduction speech signal d(n), the spectral parameter calculating circuit 10 calculates spectral parameters $\alpha_i$ with a predetermined degree, on the basis of a linear prediction analysis by the use of the reproduction speech signal d(n). For the calculation of the spectral parameters at the spectral parameter calculating circuit 10, the well-known LPC (Linear Predictive Coding) analysis, the Burg analysis, and so forth can be applied. In this embodiment, the Burg analysis is adopted. For the details of the Burg analysis, reference will be made to the description in "Signal Analysis and System Identification" written by Nakramizo (published in 1998, Corona), pages 82–87 (hereinafter referred to as Document 4). Document 4 is incorporated herein by reference.

The spectral parameters $\alpha_i$ calculated by the spectral parameter calculating circuit 10 are delivered into both of the inverse filter circuit 20 and the smoothing circuit 30.

In the inverse filter circuit 20, the inverse-filtering is carried out for the reproduction speech signal d(n) with the spectral parameters $\alpha_i$ calculated by the spectral parameter calculating circuit 10, in compliance with the following equation (1), so that the excitation signal x(n) is calculated.

$$x(n) = d(n) - \sum_{i=1}^{10} \alpha_i d(n-i) \tag{1}$$

In the smoothing circuit 30, at least one of the spectral parameters $\alpha_i$ and the RMS of the excitation signal x(n) is smoothed in time, and then the both are output into the synthesis filter circuit 40.

The smoothing of the RMS of the excitation signal x(n) is carried out, subject to the following equation (2).

$$\overline{RMS}(m)=\lambda\overline{RMS}(m-1)-(1-\lambda)RMS(m) \tag{2}$$

On the other hand, the smoothing of the spectral parameters $\alpha_i$ is carried out, subject to the following equation (3).

$$\overline{LSP}_i(m)=\lambda\overline{LSP}_i(m-1)-(1-\lambda)LSP_i(m) \tag{3}$$

In the present embodiment, the spectral parameters $\alpha_i$ is smoothed on the linear spectral pair (LSP), and then, is subjected to inverted-conversion so as to be the smoothed the spectral parameters $\alpha_i'$. For the conversion and inverted-conversion between the spectral parameters $\alpha_i$ and the LSP parameters, reference may be made to Sugamura et al, "Speech Data Compression by Linear Spectral Pair (LSP) Speech Analysis-Synthesis Technique" (Journal of the Electronic Communications Society of Japan, J64-A, pp. 599–606, 1981: hereinafter referred to as Document 5). Document 5 is incorporated herein by reference.

Then in the synthesis filter circuit 40, a synthesis filter is constructed with the spectrum parameters $\alpha_i$ output from the smoothing circuit 30, and the excitation signal x(n) is synthesized by using the synthesis filter, so that the speech signal is reproduced.

Figure 2:
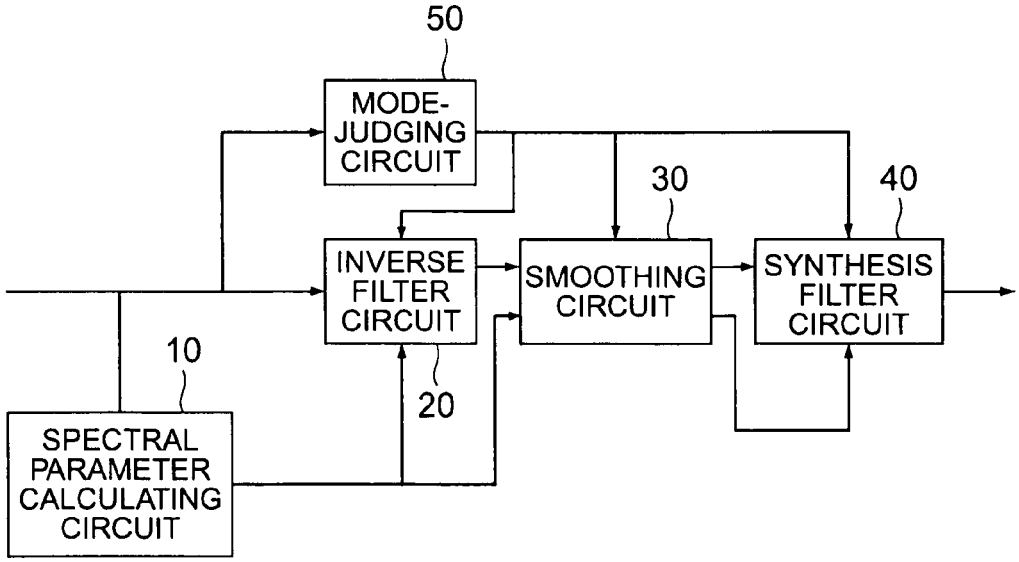
FIG. 2 is a block diagram schematically showing another speech coder according to second embodiment of this invention.

FIG. 2 is a block diagram of a reproducing circuit of a speech decoder according to second embodiment of the present invention.

As apparent from FIGS. 1 and 2, the second embodiment is a modification of the first embodiment, and both are similar to each other, except as a mode-judging circuit 50. Therefor, the common numerical references are labeled to the components in the speech decoder of the second embodiment shown in FIG. 2 and the components in the speech decoder 10 of the first embodiment shown in FIG. 1, in the case where the respective components in the speech decoders function in the similar manner. The inverse filter circuit 20, the smoothing circuit 30 and the synthesis filter circuit 40, illustrated in FIG. 2, are controlled under the mode judged on the mode-judging circuit 50, and are different from those of the first embodiment in the point of control.

When receiving the reproduction speech signal d(n), the mode-judging circuit 50 extracts feature quantities from the reproduction speech signal d(n), in accordance with the following equation (4).

$$D_T = \left[\sum_{n=0}^{N-1} d(n)d(n-T)\right] \Big/ \left[\sum_{n=0}^{N-1} d^2(n-T)\right] \tag{4}$$

Then the mode-judging circuit 50 compares the extracted feature quantities with predetermined threshold values, to thereby judge a mode of the reproduction speech signal d(n).

The judgement of the mode-judging circuit 50, namely, the judged mode is delivered into the inverse filter circuit 20, the smoothing circuit 30, and the synthesis filter circuit 40. In this embodiment, the inverse filter circuit 20, the smoothing circuit 30, and the synthesis filter circuit 40 operate in only the case where a predetermined condition is met. If the predetermined condition is met, the inverse filter circuit 20, the smoothing circuit 30, and the synthesis filter circuit 40 function in the same way of the first embodiment. If not, the inverse filter circuit 20, the smoothing circuit 30, and the synthesis filter circuit 40 do not operate, so that the reproduction speech signal is output as the speech signal.

In this embodiment, the predetermined condition is that the judged mode of the reproduction speech signal d(n) is consistent with a predetermined mode. The predetermined mode is, for example, "silence" or "unvoiced sound." If the judged mode of the reproduction speech signal d(n) is not consistent with a predetermined mode, the inverse filter circuit 20, the smoothing circuit 30, and the synthesis filter circuit 40 do not function in this embodiment.

Figure 3:
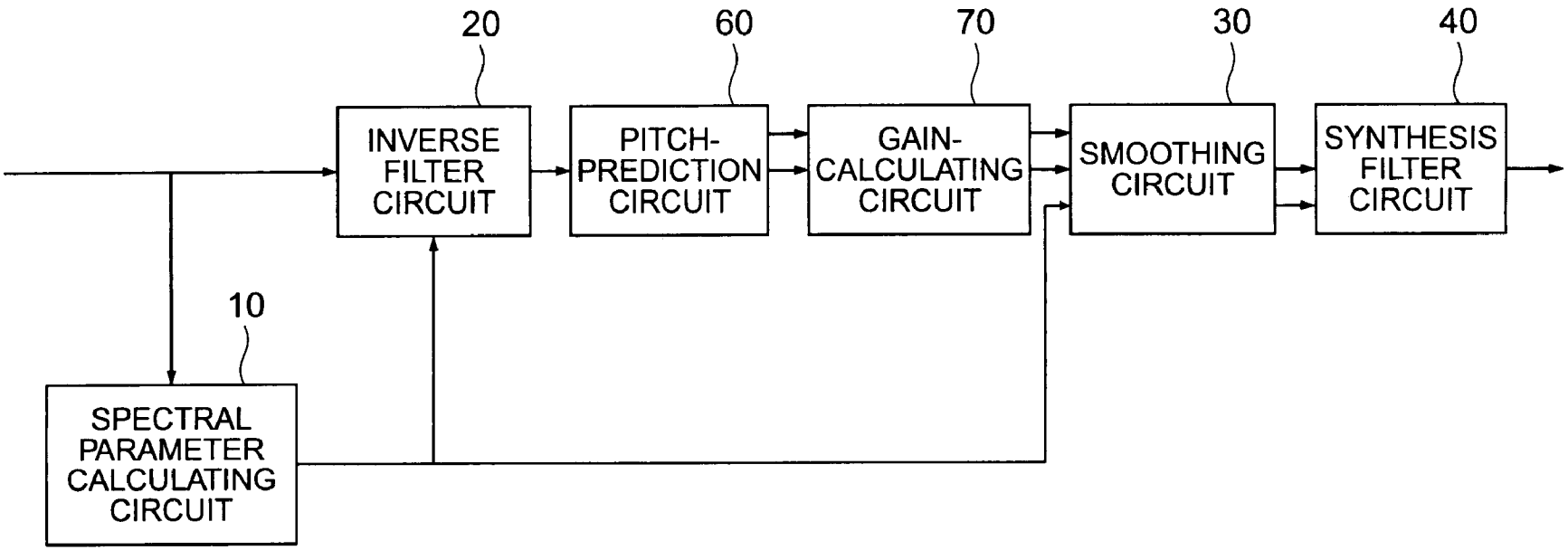
FIG. 3 is a block diagram schematically showing another speech coder according to third embodiment of this invention.

FIG. 3 is a block diagram of a reproducing circuit of a speech decoder according to third embodiment.

As apparent from FIGS. 1 and 3, the second embodiment is a modification of the first embodiment. The reproducing circuit of the present embodiment comprises a pitch-prediction circuit 60, a gain-calculating circuit 70 in addition to the spectral parameter calculating circuit 10, the inverse filter circuit 20, the smoothing circuit 30 and the synthesis filter circuit 40.

In this embodiment, the spectral parameter calculating circuit 10 and the inverse filter circuit 20 operate in the same way of the first embodiment.

The pitch-prediction circuit 60 calculates a pitch period T from either the reproduction speech signal d(n) or the excitation signal x(n). Then the pitch-prediction circuit 60 carries out a pitch prediction by the use of pitch period T to thereby produce a pitch prediction signal p(n), and calculates a residual signal e(n) by subtracting the pitch prediction signal p(n) from the excitation signal x(n). The gain-calculating circuit 70 calculates a gain of at lease one of the pitch prediction signal p(n) and the residual signal e(n) both output from the pitch-prediction circuit. The gain-calculating circuit 70 delivers the calculated gain, the pitch prediction signal p(n) and the residual signal e(n) into the smoothing circuit 30.

The smoothing circuit 30 receives the spectral parameters $\alpha_i$, the gain, the pitch prediction signal p(n) and the residual signal e(n), and smoothes in time at least one of the spectral parameters $\alpha_i$ and the gain. The smoothing circuit 30 delivers into the synthesis filter circuit 40 the spectral parameters $\alpha_i$, the gain, the pitch prediction signal p(n) and the residual signal e(n), wherein at least one of the spectral parameters $\alpha_i$ and the gain is subjected to smoothing.

The synthesis filter circuit 40 has a synthesis filter constructed with the spectrum parameters $\alpha_i$ output from the smoothing circuit, and newly produces another excitation signal as a proper excitation signal on the basis of the gain, the pitch prediction signal p(n) and the residual signal e(n). The proper excitation signal is synthesized by the use of the synthesis filter and is reproduced as the speech signal.

While the invention has been described in detail in connection with the preferred embodiments known at the time, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

The entire disclosure of Japanese Patent Application No. 2000-337805 filed on Nov. 6, 2000 including specification, claims, drawings and summary are incorporated herein by reference in its entirety.

What is claimed is:

1. A speech decoder for decoding a coded speech signal into a decoded speech signal and for reproducing a speech signal using the decoded speech signal, the decoder comprising:

a spectral parameter calculating circuit, responsive to the decoded speech signal, for calculating spectral parameters based on the decoded speech signal;

an excitation signal calculating circuit for calculating an excitation signal and for obtaining a level of the excitation signal, on the basis of the decoded speech signal and the spectral parameters;

a smoothing circuit responsive to the spectral parameters and the excitation signal, for smoothing at least one of the spectral parameters and the level of the excitation signal, so as to output the spectral parameters and the excitation signal where at least one is subjected to smoothing; and a synthesis filter circuit having a synthesis filter constructed with the spectrum parameters output from the smoothing circuit, and for synthesizing the excitation signal by using the synthesis filter, so as to reproduce the speech signal, wherein the excitation signal calculating circuit, the smoothing circuit, and the synthesis filter circuit operate only in compliance with predetermined conditions.

2. A speech decoder as claimed in claim 1, wherein the excitation signal calculation circuits carries out an inverse-filtering for the decoded speech signal by the use of the spectral parameters, so as to calculate the excitation signal.

3. A speech decoder as claimed in claim 1, further comprising:

a mode-judging circuit for judging a mode of the decoded speech signal by extracting feature quantities from the decoded speech signal, wherein the predetermined conditions comprise a mode condition that the mode of the decoded speech signal is judged as a predetermined mode by the mode-judging circuit, so that the excitation signal calculating circuit, the smoothing circuit and the synthesis filter circuit operate only when the mode condition is met.

4. A speech decoder as claimed in claim 3, wherein the predetermined mode is silence.

5. A speech decoder as claimed in claim 3, wherein the predetermined mode is "unvoiced sound."

6. A speech decoder for decoding a coded speech signal into a decoded speech signal and for reproducing a speech signal using the decoded speech signal, comprising:

a spectral parameter calculating circuit, responsive to the decoded speech signal, for calculating spectral parameters based on the decoded speech signal;

an excitation signal calculating circuit for calculating an excitation signal and for obtaining a level of the excitation signal, on the basis of the decoded speech signal and the spectral parameters;

a pitch-prediction circuit calculating a pitch period from one of the decoded speech signal and the excitation signal, where the pitch-prediction circuit carries out a pitch prediction by using the pitch period to produce a pitch prediction signal, and where the pitch-prediction circuit calculates a residual signal by subtracting the pitch prediction signal from the excitation signal;

a gain-calculating circuit for calculating a gain of at least one of the pitch prediction signal and the residual signal both output from the pitch-prediction circuit;

a smoothing circuit responsive to the spectral parameters and the gain, for smoothing at least one of the spectral parameters and the gain, so as to output the spectral parameters and the excitation signal where at least one is subjected to smoothing; and a synthesis filter circuit having a synthesis filter constructed with the spectrum parameters output from the smoothing circuit, the synthesis filter circuit produces a new excitation signal as a proper excitation signal on the basis of the gain, the pitch prediction signal and the residual signal, and thereby the synthesis filter synthesizes the proper excitation signal using the synthesis filter, so as to reproduce the speech signal.

7. A speech decoder as claimed in claim 6, wherein the excitation signal calculation circuits carries out an inverse-filtering for the decoded speech signal by the use of the spectral parameters, so as to calculate the excitation signal.

8. A method of reproducing a speech signal, comprising:

decoding a coded speech signal output from a speech coder, so as to produce a decoded speech signal;

calculating spectral parameters based on the decoded speech signal;

calculating an excitation signal and obtaining a level of the excitation signal, based on the decoded speech signal and the spectral parameters;

smoothing at least one of the spectral parameters and the level of the excitation signal, so as to output the spectral parameters and the excitation signal where at least one is subjected to the smoothing; and synthesizing the excitation signal using the synthesis filter constructed with the spectrum parameters from said smoothing, so as to reproduce the speech signal; wherein the calculating of the spectral parameters, the calculating of the excitation signal, the smoothing, and the synthesizing are carried out only when predetermined conditions are met, while the decoded speech signal is handled as the speech signal when the predetermined conditions are not met.

9. A reproducing method as claimed in claim 8, wherein the calculating of the excitation signal is carried out so that the decoded speech signal is subjected to an inverse-filtering using the spectral parameters, to thereby calculate the excitation signal.

10. A reproducing method as claimed in claim 8, further comprising judging a mode of the decoded speech signal by extracting feature quantities from the decoded speech signal, wherein the predetermined conditions comprise a mode condition that the mode of the decoded speech signal is judged as a predetermined mode.

11. A reproducing method as claimed in claim 10, wherein the predetermined mode is silence.

12. A reproducing method as claimed in claim 10, wherein the predetermined mode is "unvoiced sound."

13. A method of reproducing a speech signal, comprising:

first step of decoding a coded speech signal output from a speech coder, so as to produce a decoded speech signal;

second step of calculating spectral parameters based on the decoded speech signal;

third step of calculating an excitation signal and obtaining a level of the excitation signal, on the basis of the decoded speech signal and the spectral parameters;

fourth step of calculating a pitch period from either the decoded speech signal or the excitation signal, carrying out a pitch prediction by the use of pitch period to produce a pitch prediction signal, and subtracting the pitch prediction signal from the excitation signal to calculate a residual signal;

fifth step of calculating a gain of at lease one of the pitch prediction signal and the residual signal;

sixth step of smoothing in time at least one of the spectral parameters and the gain, so as to output the spectral parameters and the excitation signal where at least one is subjected to the smoothing; and seventh step of newly producing an excitation signal as a proper excitation signal on the basis of the gain, the pitch prediction signal and the residual signal, and then, synthesizing the proper excitation signal by the use of the synthesis filter constructed with the spectrum parameters, so that the speech signal is reproduced.

14. A reproducing method as claimed in claim 13, wherein the third step is carried out so that the decoded speech signal is subjected to an inverse-filtering using the spectral parameters, to thereby calculate the excitation signal.

* * * * *